United States Patent [19]

Garza

[11] 4,298,015

[45] Nov. 3, 1981

[54] DISHWASHER

[76] Inventor: Antonio M. Garza, Jamaica #401, Vista -- Hermosa, Monterrey, N.L., Mexico

[21] Appl. No.: 102,861

[22] Filed: Dec. 12, 1979

[51] Int. Cl.[3] ..... B08B 3/02

[52] U.S. Cl. ..... 134/100; 134/181; 239/226; 239/240

[58] Field of Search ..... 134/93, 100, 141, 179, 134/181, 198; 239/225, 237, 240, 226

[56] References Cited

U.S. PATENT DOCUMENTS

| | | | |
|---|---|---|---|
| 2,414,052 | 1/1947 | Martin | 239/240 X |
| 3,419,023 | 12/1968 | Valdespino | 134/179 X |
| 3,428,060 | 2/1969 | Spivey | 134/141 |
| 3,934,822 | 1/1976 | Ross | 134/93 X |

FOREIGN PATENT DOCUMENTS

| | | | |
|---|---|---|---|
| 659174 | 1/1964 | Italy | 134/141 |

*Primary Examiner*—Robert L. Bleutge

*Attorney, Agent, or Firm*—Laurence R. Brown

[57] ABSTRACT

A dishwasher has a tub, dish rack and transparent lid cover with a centrally disposed turbine hydraulically actuated motor on the bottom of the tub. The motor has internal piping to lead water to a spray arm rotated by the turbine past a turbulence chamber serving to suck a charge of detergent into the water flow stream which when spent permits a water rinse. A rack has removable dish support clip members fixed onto rods or webs so that the only moving part is the turbine rotor and attached spray arm.

6 Claims, 6 Drawing Figures

FIG. 2
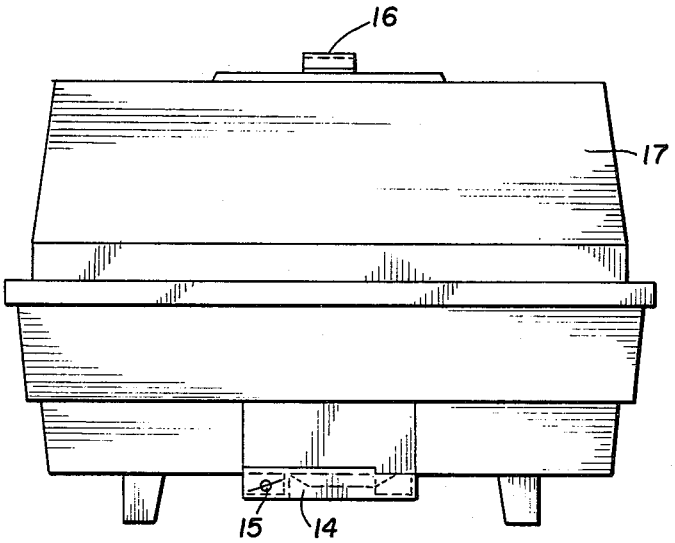
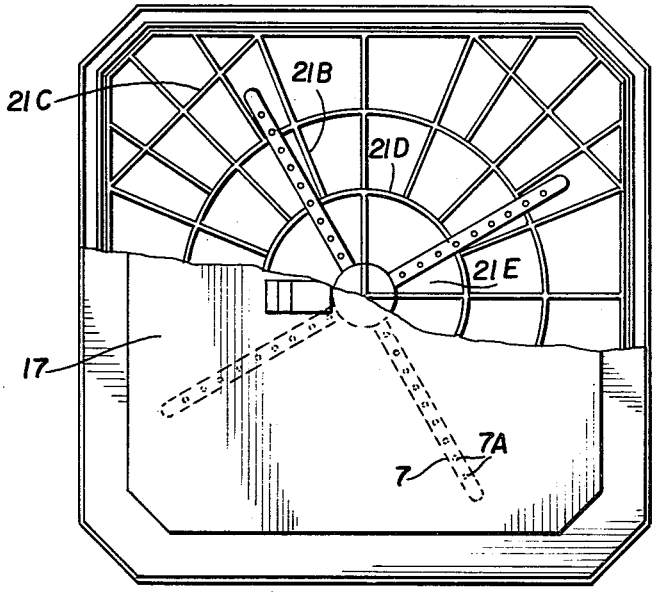
FIG. 3

DISHWASHER

FIELD OF THE INVENTION

This invention relates to a dishwasher, and more particularly it relates to hydraulic motor operated dishwashers.

BACKGROUND ART

Dishwashers operating on electrical energy not only use fossil fuel energy which is in scarce supply, but cannot be used in locations without electrical energy. However, when a water supply is available, the hydraulic pressure may be used to power a dishwasher.

It is a problem to operate dishwashers with hydraulic motors because of changes of water pressure, and because water pressure can be very low. Also, water is a scarce resource and should be conserved, so a hydraulically operated dishwater should use water efficiently and yet should have a rapid washing cycle.

It is therefore an object of this invention to provide hydraulic motor operated dishwashers operable on low water pressure of the order of 0.4 $Kg/cm^2$ (5.5 psi), and operable when the water pressure changes significantly above that minimum pressure.

Another object of this invention is to provide a dishwasher that uses water and detergent efficiently in a rapid washing cycle while being low in cost.

BRIEF DESCRIPTION OF THE INVENTION

Thus, there is afforded by this invention a dishwasher with a hydraulic turbine type motor actuated by water pressure to propel spray arms distributing water and detergent within a tub having a removable top and an internal grillwork rack for holding dishes.

Water under pressure is entered to strike turbine blades for rotary movement of a spinning spray arm array disposed under the rack of dishes to be washed. The water passes upwardly on sloped turbine surfaces into the spray arm and past a turbulence chamber which draws in detergent from a front panel accessible reservoir. Spent water is discharged from drains in the tub.

BRIEF DESCRIPTION OF THE DRAWINGS

In the drawings:

FIG. 2 is an elevation front view of a dishwasher cabinet and control panel;

FIG. 3 is a plan view, partly broken away to show the interior tub;

DETAILED DESCRIPTION OF A PREFERRED EMBODIMENT

The dishwasher provided by this invention operates with a minimum hydraulic pressure of 0.4 $Kg/cm^2$ (5.5 psi), utilizing the pressure energy of the water to propel spray arms, draw detergent from a supply and scrub dishes placed in a grillwork rack on special support elements.

Figure 1:
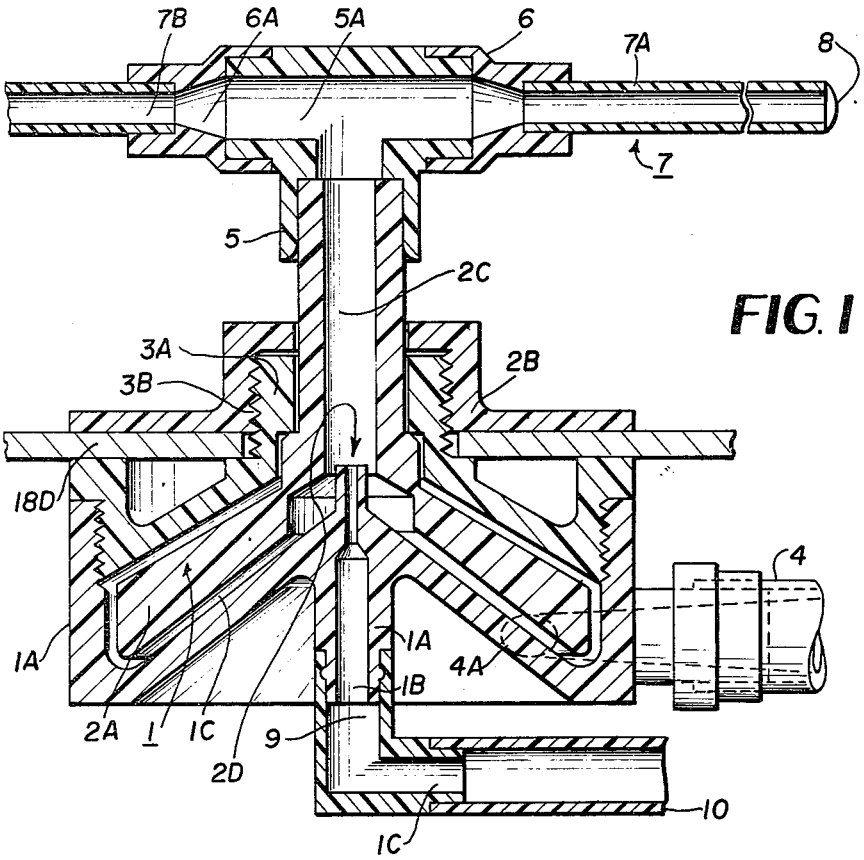
FIG. 1 is a section view of the turbine spray assembly using hydraulic pressure to wash dishes.

The fluid energy is transformed into mechanical energy by the turbine 1, shown in FIG. 1, having blades 2A of a turbine rotor disposed within housing 1A. The housing is preferably of plastic and is so cross sectioned since plastic is easier to form and does not tend to corrode. However, portions of the dishwasher may be made of metal if desired.

Cross piece 5 is joined to the turbine rotor shaft for rotation therewith of the extension spray arms 7, all being hollow such as turbine shaft piping 2C and spray arm piping 7B. Spray holes 7A extend through the upper part of the spray arms 7. The reduction fitting 6 has a conical piping section 6A to produce a higher speed and pressure spray force out of the holes 7A. Each spray arm has an end cap 8. The T-fitting 5 with piping 5A is splined or otherwise affixed to the turbine shaft to rotate therewith.

Water under main pressure enters at water line 4 into the orifice 4A to hit turbine rotor vanes 2A and propel them. The inclined inner turbine blade walls 1C of the turbine housing 1A also pass water up an incline toward the vertical piping 2C of turbine shaft 2B suitably mounted within bearing members 3A, 3B holding the turbine assembly on the bottom center 18D of the washer tub assembly.

When the fluid hits the inclined wall 1C it generates two force components, a horizontal speed component that increases the rotor speed and a vertical speed component greater than the horizontal speed which passes turbulence chamber 2D, vertically flows through piping 2C and leaves spray holes 7A. The water supply may be turned off and on by control knob 15 on the front panel either for manual control or for a specified time period through an appropriate control device.

The turbulence chamber 2D generates a decrease in pressure (vacuum) in jet pipe 1B which pulls or sucks and mixes with incoming water detergent or soap liquid from around elbow 9, passage 1C and piping 10 from the front panel accessible detergent storage bin 14. The spent detergent solution is drained from the tub 18 through drain 19.

Just enough detergent is placed in storage bin 14 to satisfactorily wash the dishes taking into account water hardness and the nature of the dishes, etc. and after this is spent, the detergent free water rinses the dishes, without futher control means.

Figure 5:
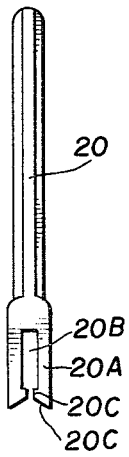
FIGS. 5 and 6 show in elevation end and side view removable dish support members forming a dish holding grill within the washer tub.
Figure 6:
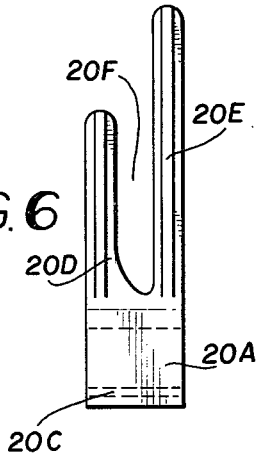
Figure 4:
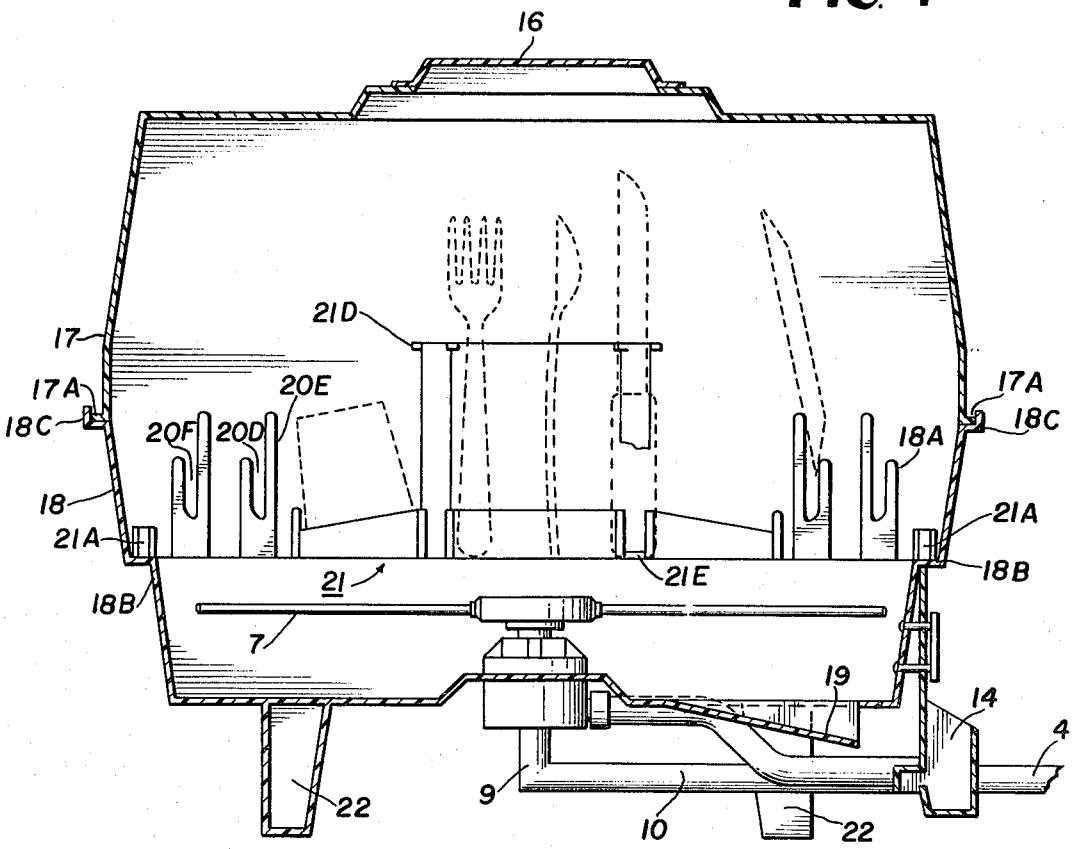
FIG. 4 is an elevation view partly in section of the dishwasher assembly.

The dishwasher has a removable top cover 17 with handle 16 interfitting in joint 17A, 18C with tub 18, and a removable grill rack 21 with radial and transverse rod or web elements 21B, 21C, etc., on which dish receiving support elements 20 are fitted of the nature shown in FIGS. 4, 5 and 6. Thus the dish support elements have a cavity 20F between legs 20D and 20E for receiving dishes. Also a central basket 21D with drainage sieve 21E provides a rack for cutlery, silverware and other utensils. The grill rack 21 has a rim 21A setting on shoulder 18B of the tub.

As seen from FIGS. 5 and 6 the dish receiving support elements 20 have a clamp with lips and mouth 20C and spreadable legs 20A forming a clip that permits recess 20B to set over and clamp firmly onto the grill rod elements 21B, 21C, etc. The long 20E and short 20D legs of the dish receiving support provide a convenient holder for dishes, cups, glasses, and similar utensils, while being washed and drained.

The tub 18 rests on legs 22 (FIG. 4). The cover lid 17 is preferably made of transparent or translucent plastic to permit visibility inside tube 18, which can have any desired shape, round, hexagonal, etc.

INDUSTRIAL APPLICATION

A simple inexpensive dishwasher operational solely from hydraulic water pressure quickly and effectively cleans dishes by means of a rotating spray arm carrying a sequence of detergent wash water and rinse water operates at a low mains pressure in the order of 0.4 $Kg/cm^2$.

I claim:

1. A hydraulically operated dishwasher comprising in combination, motive means comprising a hydraulic rotatable turbine coupled to a water inlet channel to cause rotation thereof in response to water flow inpact into a turbine member by water passed from a water main into said inlet channel, a water flow path through said turbine, a rotatable spray arm coupled for rotation by the rotatable turbine including a transit channel for passing the water flow from said turbine through spray outlets forcefully in a predetermined direction for washing dishes, and a rack for placing dishes to be cleaned in the spray path of said arm and holding the dishes, such as plates, disposed substantially along said predetermined direction of spray, thereby to be washed by the water flowing through the motive means and the sray arm wherein the turbine has a set of conically disposed blades surrounded by a housing with a conical member extending from said transit channel down an inclined path with the water flow path to the spray arm directed up the inclined path.

2. A dishwasher as defined in claim 1 wherein said rack comprises a web network and detachable dish-support clip members disposed thereon having a pair of legs and a central space therebetween for receiving the dishes.

3. A dishwasher as defined in claim 1 having a removable transparent top lid covering said rack.

4. A dishwasher as defined in claim 1 with the sole moving part being a turbine rotor with attached water spray arm.

5. A dishwasher as defined in claim 1 wherein the water directed up the inclined path converges in a region in said transit channel thereby creating a suction force, detergent flow channel means directed upwardly through said conical member into said region, and means coupling said detergent flow channel means with a detergent reservoir of capacity for cleaning a load of dishes on said rack, whereby the detergent is drawn into the water flow path to the spray arm by the suction provided by the flow of water through said turbine.

6. A dishwasher as defined in claim 1 wherein the spray arm rotates below the rack and the spray is directed onto the dishes upwardly through the rack.

* * * * *

UNITED STATES PATENT AND TRADEMARK OFFICE

CERTIFICATE OF CORRECTION

PATENT NO. : 4,298,015

DATED : November 3, 1981

INVENTOR(S) : Antonio Mata-Garza

It is certified that error appears in the above—identified patent and that said Letters Patent is hereby corrected as shown below:

On the title page, inventor's name should read:

-- Antonio Mata-Garza --.

Signed and Sealed this

*Second* Day of *February 1982*

[SEAL]

*Attest:*

GERALD J. MOSSINGHOFF

*Attesting Officer*

*Commissioner of Patents and Trademarks*